US005832698A

United States Patent [19]

Huguenin

[11] Patent Number: 5,832,698

[45] Date of Patent: Nov. 10, 1998

[54] METHOD OF MANUFACTURING A FLEXIBLE PACKAGE COMPRISING A POURING CHANNEL, AND PACKAGE OBTAINED BY THE METHOD

[75] Inventor: Freddy Huguenin, Lausanne, Switzerland

[73] Assignee: PLK Verpackungssysteme GmbH, Linnich, Germany

[21] Appl. No.: 454,396

[22] PCT Filed: Dec. 13, 1993

[86] PCT No.: PCT/EP93/03513

§ 371 Date: Jun. 20, 1995

§ 102(e) Date: Jun. 20, 1995

[87] PCT Pub. No.: WO94/14676

PCT Pub. Date: Jul. 7, 1994

[30] Foreign Application Priority Data

Dec. 21, 1992 [FR] France ..... 92 15687

[51] Int. Cl.[6] ..... B65B 9/06; B65D 33/01

[52] U.S. Cl. ..... 53/451; 383/40; 383/38; 383/58; 383/904; 383/906

[58] Field of Search ..... 53/451; 383/38, 383/40, 904, 906, 58, 44

[56] References Cited

U.S. PATENT DOCUMENTS

| | | | |
|---|---|---|---|
| 1,053,605 | 2/1913 | Johnson | 383/44 |
| 2,654,527 | 10/1953 | Geckler et al. | 383/40 |
| 2,799,314 | 7/1957 | Dreyer et al. | 383/904 |
| 2,800,269 | 7/1957 | Smith | 383/38 |
| 2,998,340 | 8/1961 | Conway et al. | 383/906 |
| 3,180,558 | 4/1965 | Quaadgras et al. | 383/58 |
| 3,383,017 | 5/1968 | Krings | 384/904 |
| 4,312,473 | 1/1982 | Hoeller | 383/38 |
| 4,557,377 | 12/1985 | Maloney | 383/38 |
| 5,322,579 | 6/1994 | Van Erden | 53/451 |
| 5,351,828 | 10/1994 | Becker et al. | 383/58 |
| 5,538,155 | 7/1996 | Hoekstra | 383/38 |
| 5,551,208 | 9/1996 | Van Erden | 53/451 |

FOREIGN PATENT DOCUMENTS

| | | | |
|---|---|---|---|
| 557775 | 5/1958 | Canada | 383/904 |
| 190385 | 8/1986 | European Pat. Off. | 383/38 |
| 8602848 | 6/1988 | Netherlands | 383/38 |
| 1021167 | 3/1966 | United Kingdom | 383/58 |

*Primary Examiner*—Stephen P. Garbe
*Attorney, Agent, or Firm*—Standley & Gilcrest

[57] ABSTRACT

A method for forming a discharge channel (6) in a flexible packaging during the manufacture thereof. The channel is adjacent to at least one of the edges of the packaging and extends from one end to the other of said packaging. At least one of the channel ends is sealed and in internal communication with the main compartment while the other may be opened for pouring. According to the method, a strip-like partition is inserted between the two side walls of the packaging and at least one longitudinal mid-portion (13) of the strip constitutes said partition and has evenly spaced communicating means (8) arranged above the bottom seal (10) of the packaging, and each side wall of the packaging is sealed to one edge of the partition. Alternative embodiments of such a packaging are also disclosed.

1 Claim, 2 Drawing Sheets

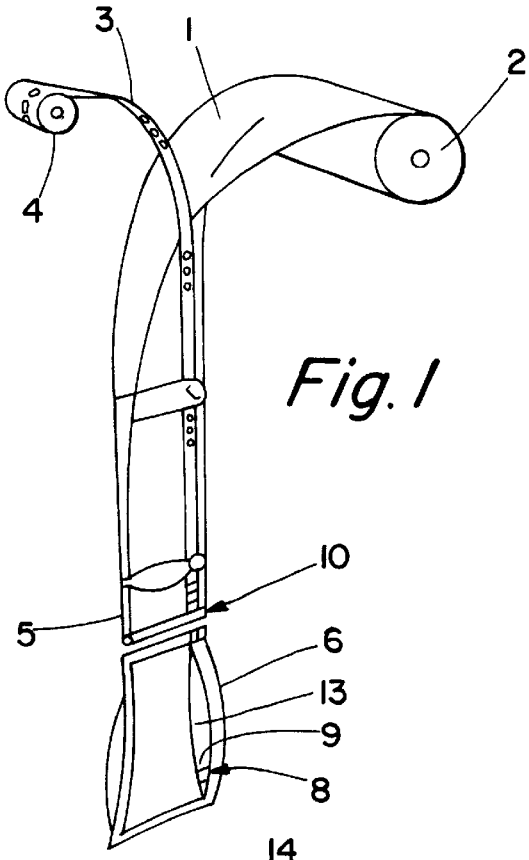
Fig. 1
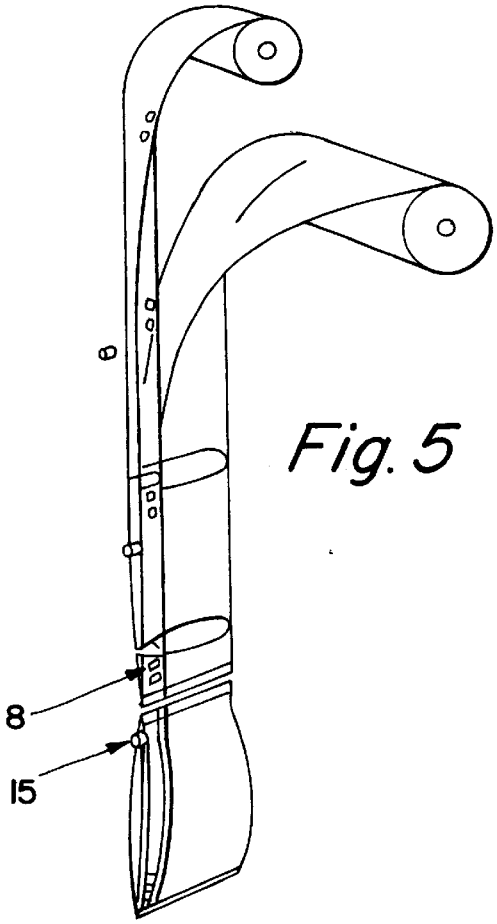
Fig. 5
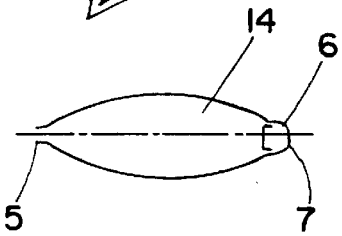
Fig. 2
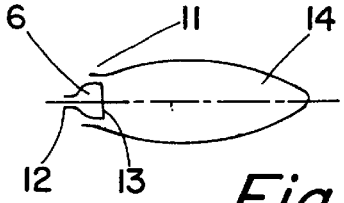
Fig. 6
Fig. 4
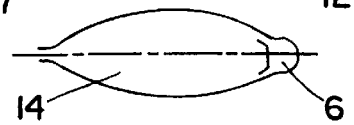
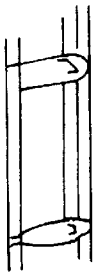
Fig. 3
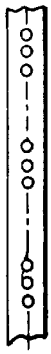
Fig. 10
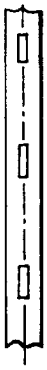
Fig. 11
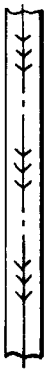
Fig. 12
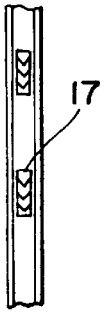
Fig. 13

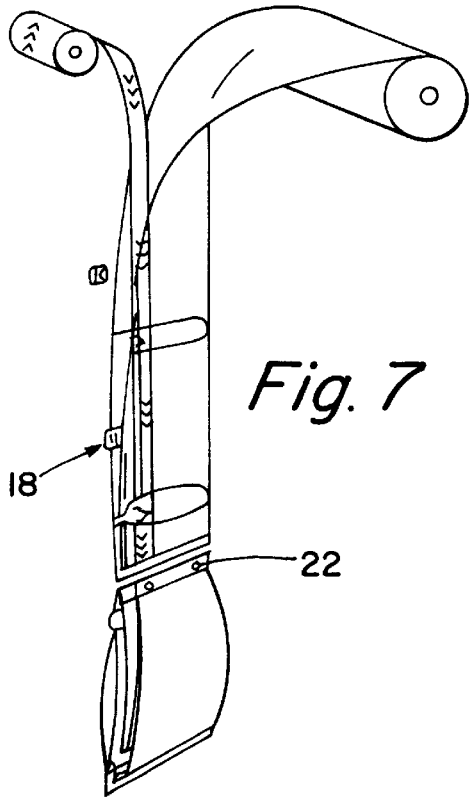
Fig. 7
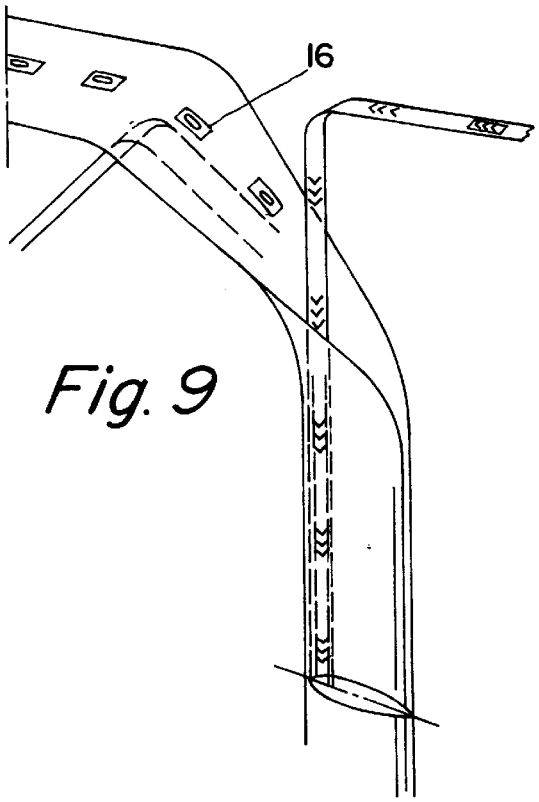
Fig. 9
Fig. 8
Fig. 20
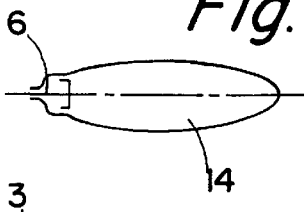
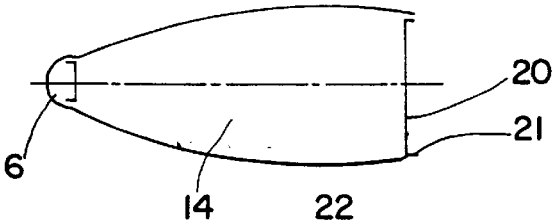
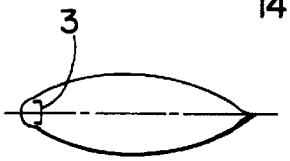
Fig. 14
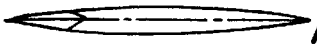
Fig. 15
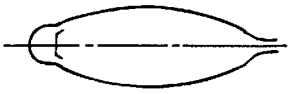
Fig. 16
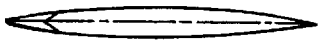
Fig. 17
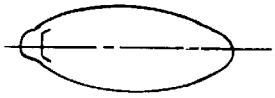
Fig. 18
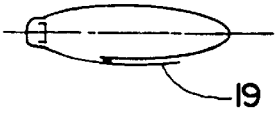
Fig. 19
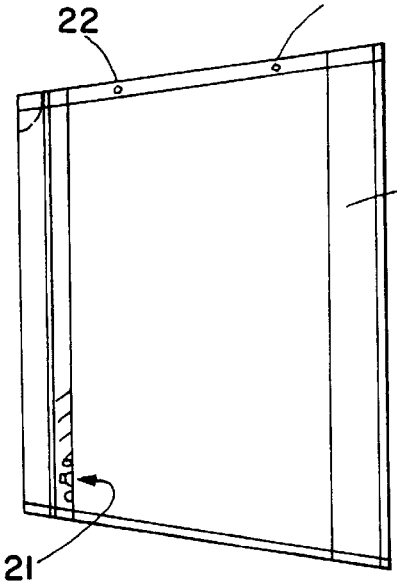
Fig. 21
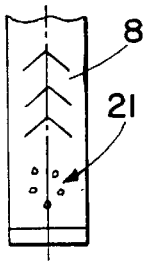
Fig. 22

METHOD OF MANUFACTURING A FLEXIBLE PACKAGE COMPRISING A POURING CHANNEL, AND PACKAGE OBTAINED BY THE METHOD

FIELD OF THE INVENTION

The present invention relates to a method of manufacturing a flexible package for liquid or pasty products which includes a pouring channel, and it also relates to the package obtained by the method.

PRIOR ART

A package is already known of the forementioned type, which forms the subject of Patents CH 678,614 and EP 0,377,882 in the name of the Applicant.

It includes a channel adjacent to one of its edges, extending from one end right to a second end, at least one of the two ends being sealed off and intended to be opened in order to draw off the contents and at least one of the two ends being in communication with the main compartment.

The channel is formed conventionally by bringing together two side walls of the package, for example by welding or preferably by mechanical pinching by means of an independent pinching device.

The main aim sought was to improve the duration of preservation of the contents, after opening the package. The reason for this is that, after discharging part of the contents, the contents remaining in the main compartment have not been in contact with air during discharge.

However, the technique of separating the channel from the main compartment by welding has drawbacks from a robustness point of view—it may happen that the weld does not withstand the pressure of the contents during discharge.

Moreover, the pinching system is not always correctly used by the consumer.

SUMMARY OF THE INVENTION

The object of the present invention is to provide a novel technique for the formation of the means for separating the channel form the main compartment. The basic concept consists in forming this separation by means of an attached thin strip which is welded by its edges to the side walls of the package and in which a means of communication is provided between the main compartment and the channel.

More particularly, the invention consists of a method of forming a discharge channel during the manufacture of a flexible package, which channel is adjacent to at least one of the edges of the package and extending from a first end of the package right to the second end, at least one of the ends of the channel being sealed off and in internal communication with the main compartment, the other end being intended to be opened for discharging, characterized in that a partition in the form of a strip is inserted between the two side walls of the package, at least one longitudinal central region of which partition-forming strip has uniformly spaced means of communication arranged so as to be placed above the bottom weld of the package, and in that each side wall of the package is welded to one edge of the partition.

The invention also relates to a package obtained by the method, characterized in that it includes a partition in the form of a strip arranged parallel to one edge of the package in order to form a channel and a main chamber and connecting, in a sealed manner, the side walls of the package from one of its ends right to the other end, the said partition including, in the vicinity of one of its ends, means of communication in order to allow passage of the contents.

BRIEF DESCRIPTION OF THE DRAWINGS

FIG. 1: Sketch showing diagrammatically the manufacture of a first embodiment of a package according to the invention.

FIG. 2: Cross-section of the package depicted in FIG. 1.

FIG. 3: Sketch corresponding to a second embodiment.

FIG. 4: Cross-section of the package depicted in FIG. 3.

FIG. 5: Sketch corresponding to a third embodiment.

FIG. 6: Cross-section of the package depicted in FIG. 5.

FIG. 7: Sketch corresponding to a fourth embodiment.

FIG. 8: Cross-section of the package depicted in FIG. 7.

FIG. 9: Sketch corresponding to a fifth embodiment.

FIGS. 10 to 12: Embodiments of the means of communication which are provided in a separating strip according to the invention.

FIG. 13: Separating strip, the means of communication of which are provided with valve-forming means.

FIGS. 14 to 20: Cross-sections of other possible embodiments of the packages according to the invention.

FIG. 21: A side-on view of an alternative form of package, the shape of which is not rectangular.

FIG. 22: Detailed view of an embodiment of the strip (3).

WAYS OF CARRYING OUT THE INVENTION

Reference should firstly be made to FIGS. 1 and 2.

A main sheet (1) coming from a primary supply roll (2) is wound around a filling mandrel, not shown, so as to produce a compartment with a single side weld (5). The absence of a second side weld decreases the cost of manufacture and increases the strength of the package.

Simultaneously, another sheet (3) in the form of a strip is supplied from a secondary supply roll (4) and inserted inside the compartment formed by the main sheet, and each of the edges of the strip is welded to a wall of the compartment by cooperation with the filling mandrel so as to form a channel (6) of smaller cross-section passing along the non-welded edge (7) of the main sheet (1).

The strip has a means of communication (8), for example a group of circular openings such as (9), these being three in number in the figures, which groups are arranged at regular intervals along the strip (3) and above a bottom weld (10). Next, the package is filled with the product, supplied via the inside of the mandrel, right to the bottom of the package.

There follow the conventional operations of welding the top part of a package, the bottom of the next package and of their separation, the strip (3) being welded and cut at the same time as the main sheet.

According to this first embodiment, the channel (6) is provided adjacent to the edge (7) opposite the longitudinal weld (5) of the package and the edges of the strip (3) are folded over so as to face this edge (7) and the channel (6) while they are being welded.

The embodiment of FIGS. 3 and 4 differs from that of FIGS. 1 and 2 by the edges of the strip (3) which are folded over so as to face the weld (5) and hence the main compartment (14).

The embodiment of FIGS. 5 and 6 is distinguished by its channel (6) formed from a wider strip (3) wound over a second mandrel and sealed by pinching and welding its two edges (12) together. The two edges (11) of the main sheet are attached and welded on either side of the channel (6) thus formed.

In this particular case, only a central region (13) of the strip acts as a separating partition, and it is this region which, of course, has the means of communication (8).

The embodiment of FIGS. 7 and 8 is distinguished by the position of the channel (6) adjacent to the welded edge (5) of the package.

FIGS. 10 to 12 show various possible and non-limiting shapes of the means of communication (8): these are single straight slits, curved slits in the form of a circumflex accent, etc. or cut-outs with material to be removed, for example square cut-outs, triangular cut-outs, circular cut-outs, curved cut-outs, cut-outs in the form of circumflex accents, etc. These shapes of slits and cut-outs may be combined together and the number of them can be varied.

In FIGS. 13 and 19, the means of communication are equipped with valve-forming means in the form of attached flaps (17) which are welded at their upper part only and form a non-return valve in order to slow down the movement of the product and to prevent it from mixing, that is to say to further decrease thereby the return into the main compartment (14) of some of the product which could have been in contact with air at the time of discharge and to further decrease thereby the risks of contaminating the contents, and therefore to increase its duration of preservation.

For any one of the aforementioned embodiments, the opening of the top part of the channel, more precisely the end of the channel opposite that which includes the means of communication (8), may be produced in different ways so as to discharge the product.

It is possible quite simply to cut off the upper corner of the channel or to cause discharge by an appropriate means, for example a sharpened straw or any other means.

For the purpose of partial discharge and resealing after discharge, it is possible, for example, to include at the top of the channel of each package a flexible tube (15) (FIG. 5) capped off by a strip, plug, etc., or to provide a tunnel (18) (FIG. 7) equipped with small impermeable and flexible catching means called "mini-grif", or else to provide a tear tab welded to a weakened region, or alternatively an adhesive (16) sealing off a precut opening (FIG. 9).

FIGS. 14 to 21 show, in horizontal cross-sections, various possible configurations, one preferred configuration being that of FIG. 14 with the edges of a very thin strip (3) facing the channel and structuring it well, preferably with openings in the form of an upside-down circumflex accent limiting the return flow.

The packages may include a weld on a side wall (FIGS. 18 and 19) and/or one or two longitudinal welds (FIGS. 14 to 17) and/or a folded shape of the partition-forming strip, the fold facing the centre of the main compartment (FIG. 15) or facing the channel (FIG. 17) allowing the package to be flattened and making it more suitable for less fluid products, like cosmetics.

In the case of FIG. 19, the sheet of the central compartment is extended beyond the weld in order to form a printing region (19) intended to bear a message, for example of an advertising nature. This extension (19) could be provided even in the case of welding to the edge (5).

In FIGS. 20 and 21, the weld of the sheet of the main compartment (14) is replaced by another sealing means.

The compartment is sealed by a secondary sheet (20) welded by its two edges (21) to the edges of the main sheet and then welded and cut at the top and bottom of the package at the same time as the latter. This sheet (20) forms a wall which can fold over towards the inside of the package in order to flatten it. With this type of means of sealing the main compartment, it is possible to provide an extension either of the sheet (20) or of the sheet (1) in order to bear a message, for example an advertising message.

The overall shape of the package is not necessarily rectangular—by way of example, the package of FIG. 21 is trapezoidal.

In general, all combinations of the various forms of welding and forming the channel (3), of the means of communication (8), of sealing and forming the main chamber (14) are possible, only a few of these combinations having been shown in a non-limiting manner.

Furthermore, for certain types of contents it may be necessary to add, to the strip (3) between the bottom of the package and the means of communication (8) (whatever their shape), additional draining means (21).

For example, in FIG. 22, small holes (21) are added to the cut-outs in the form of circumflex accents.

Thus, after removing most of the contents, the rest may be extracted in order to prevent wastage.

In addition, and in a manner known per se, it is possible to use each embodiment of the package in accordance with the invention with a rigid support, by hooking up the package by means of holes (2) (for example in FIGS. 22 and 7) and/or with means of compression of the side walls of the main compartment if the contents are viscous or pasty (for example a sauce, mustard, etc.) so as to force these contents to rise up the channel and to escape.

Finally, the package in accordance with the invention may be made of various materials depending on the nature of the contents. It is particularly suitable for alimentary liquids, such as fruit juices, milk, oils, sauces of varying degrees of fluidity, etc., but also to cosmetics, refills of detergents or of any liquid cleaning products, etc.

I claim:

1. A method of forming a package having a channel and a main compartment, said method comprising:

providing a main sheet having two side edges;

providing a strip having two side edges and a central region, said central region having at least one opening;

welding said two side edges of said strip together to form said channel;

welding said two side edges of said main sheet to said central region of said strip to form said main compartment;

welding and cutting bottom portions of said channel and said main compartment to form a bottom edge of said package; and welding and cutting top portions of said channel and said main compartment to form a top edge of said package;

wherein said at least one opening in said central region of said strip allows internal communication between said channel and said main compartment.

* * * * *